US011752780B2

(12) United States Patent
Nagao

(10) Patent No.: US 11,752,780 B2
(45) Date of Patent: Sep. 12, 2023

(54) IMAGE-FORMING APPARATUS HAVING HEATER UPSTREAM OF IMAGE FORMER

(71) Applicant: Konica Minolta, Inc., Tokyo (JP)

(72) Inventor: Shinichi Nagao, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/726,660

(22) Filed: Apr. 22, 2022

(65) Prior Publication Data

US 2022/0342352 A1 Oct. 27, 2022

(30) Foreign Application Priority Data

Apr. 22, 2021 (JP) ..... 2021-072734

(51) Int. Cl.
*B41J 11/00* (2006.01)
*G03G 15/20* (2006.01)
*G03G 15/00* (2006.01)

(52) U.S. Cl.
CPC ..... *B41J 11/0015* (2013.01); *B41J 11/00244* (2021.01); *G03G 15/2017* (2013.01); *G03G 15/6558* (2013.01)

(58) Field of Classification Search
CPC ..... G03G 15/2017; G03G 15/6558; G03G 21/206; G03G 2215/00666; B41J 2/38; B41J 11/0015; B41J 11/00244; B41J 29/12; B41J 29/377
USPC ..... 399/92, 328, 336, 390; 347/101, 102
See application file for complete search history.

(56) References Cited

U.S. PATENT DOCUMENTS 5,896,154 A * 4/1999 Mitani ..... B41J 11/0024 347/102
6,240,265 B1 * 5/2001 Noh ..... G03G 15/2017 399/92
6,244,700 B1 * 6/2001 Kimura ..... B41J 11/00216 347/102
6,536,894 B1 * 3/2003 Rasmussen ..... B41J 11/0024 400/120.01
8,894,303 B2 * 11/2014 Monclus ..... B41J 11/00216 399/388
2013/0044171 A1 * 2/2013 Sasaki ..... B41J 11/00216 347/102
2014/0028768 A1 * 1/2014 Chen ..... B41J 3/4078 347/102

(Continued)

FOREIGN PATENT DOCUMENTS

JP 2010162701 A 7/2010
JP 2014148132 A * 8/2014 ..... B41J 11/002
JP 2019104198 A 6/2019

*Primary Examiner* — Robert B Beatty
(74) *Attorney, Agent, or Firm* — CANTOR COLBURN LLP

(57) ABSTRACT

An image-forming apparatus that can restrict reduction in the accuracy of image formation onto a recording material is provided. An image-forming apparatus includes an image-former that discharges ink to a conveyed recording material; a recording-material heating unit that is disposed in an upstream side of the image-former; a chassis that covers the recording-material heating unit; and a shielding member that is disposed between the chassis and the image-former and shields inflow of air, which is discharged from a recording-material outlet, into the image-former.

12 Claims, 9 Drawing Sheets

(56) References Cited

U.S. PATENT DOCUMENTS

| | | | | |
|---|---|---|---|---|
| 2015/0336404 | A1* | 11/2015 | Sasaki | B41J 11/0024 347/101 |
| 2016/0152046 | A1* | 6/2016 | Hollands | B65H 5/226 242/430 |
| 2019/0240995 | A1* | 8/2019 | Shiki | B41J 13/0009 |
| 2020/0247145 | A1* | 8/2020 | Yoda | B41J 11/0022 |
| 2022/0339949 | A1* | 10/2022 | Nagao | B41J 11/0021 |

* cited by examiner

IMAGE-FORMING APPARATUS HAVING HEATER UPSTREAM OF IMAGE FORMER

CROSS-REFERENCE TO RELATED APPLICATIONS

The present invention claims priority under 35 U.S.C. § 119 to Japanese Application, 2021-072734 filed on Apr. 22, 2021, the entire contents of which being incorporated herein by reference.

BACKGROUND

Technological Field

The present invention relates to an image-forming apparatus.

Description of the Related Art

There is an image-forming apparatus which discharges ink onto a recording material to form an image on the recording material. Many of the inks used in the image-forming apparatus have differences in a final state such as color development or glazing depending on the temperature state, etc. after landing on the recording material. In such a case, temperature control for heating the recording material to an appropriate temperature is important.

As a method of heating the recording material before ink landing to an appropriate temperature, a configuration in which a contact-type heating unit using a heating roller or the like in an upstream side of an image-former is widely used (for example, see Patent Literature 1). In this heating unit, the recording material which is an ink discharge target is caused to abut the heating roller to heat the recording material to an appropriate temperature in advance before landing of the ink.

Also, there has been proposed an image-forming apparatus having a configuration in which, after an image is formed by discharging ink, the recording material is heated in the heating unit to dry the landed ink (for example, see Patent Literature 2). In this image-forming apparatus, the damage on the formed image or the surface of the recording material caused by contact with the heating roller or the like is restricted by using the heating unit of a contactless type.

Also, in an image-forming apparatus, with the configuration provided with the heating unit of the contactless type, the heated air used in the heating unit to dry the ink tend to flow into an image-former, which is disposed in the upstream side of the heating unit. When the heated air flows into the image-former, an ink head unit is heated, and temperature increase of the ink head unit, deterioration in the accuracy of landing positions, nozzle clogging due to drying of the ink, etc. are caused. As a measure therefor, in an image-forming apparatus according to Patent Literature 2, a windproof plate is provided between an image-former and a heating unit of a contactless type.

RELATED ART LITERATURE

Patent Literature

Patent Literature 1: JP 2019-104198 A
Patent Literature 2: JP 2010-162701 A

SUMMARY

In the configurations of the image-forming apparatuses according to above described Patent Literature 1 and Patent Literature 2, if the heating unit of the contactless type is applied in order to heat the recording material before image formation for temperature control of the recording material, the air heated by the heating unit tend to flow into the image-former, and, for example, deterioration in the accuracy of the landing position is caused due to the temperature increase of the ink head unit.

In the configuration of the image-forming apparatus according to Patent Literature 2, the windproof plate is provided in order to prevent backflow of the heated air to the image-former. However, a configuration which prevents inflow of the heated air from the heating unit, which is disposed in the upstream of the image-former, to the image-former is not described. Therefore, in the configuration of the image-forming apparatus according to above-described Patent Literature 2, for example, deterioration in the accuracy of the landing position due to the inflow of the heated air to the image-former is caused. As a result, in the image-forming apparatus, the accuracy of image formation onto the recording material is lowered. Particularly, in recent configurations, the heating unit and the image-former tend to be close to each other due to speed-up of the conveyance velocity of the recording materials or downsizing of the apparatus. Therefore, a configuration which restricts lowering in the accuracy of image formation onto the recording material is required.

In order to solve the above-described problems, the present invention provides an image-forming apparatus that can restrict reduction in the accuracy of image formation onto a recording material.

An image-forming apparatus of the present invention is provided with: a conveyer that conveys a recording material on a conveyance path; an image-former that discharges ink onto the conveyed recording material; a recording-material heating unit that heats the recording material disposed in an upstream side in a conveyance direction of the recording material with respect to the image-former; a chassis that covers the recording-material heating unit, has a recording-material inlet provided in the upstream side in the conveyance direction of the recording material with respect to the recording-material heating unit, and has a recording-material outlet provided in a downstream side in the conveyance direction of the recording material with respect to the recording-material heating unit; and a shielding member that is disposed above the conveyance path and between the recording-material outlet and the image-former and shields inflow of air into the image-former, the air being discharged from the recording-material outlet.

According to an embodiment of the present invention, an image-forming apparatus that can restrict reduction in the accuracy of image formation onto the recording material can be provided.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Hereinafter, examples of embodiments for carrying out the present invention will be described, but the present invention is not limited by the following examples.

Note that the descriptions will be given in a following order.

1. First Embodiment of Image-Forming Apparatus
2. Second Embodiment of Image-Forming Apparatus
3. Third Embodiment of Image-Forming Apparatus
4. Fourth Embodiment of Image-Forming Apparatus
5. Fifth Embodiment of Image-Forming Apparatus
6. Sixth Embodiment of Image-Forming Apparatus
7. Seventh Embodiment of Image-Forming Apparatus

1. First Embodiment of Image-Forming Apparatus

Hereinafter, a specific embodiment of an image-forming apparatus of the present invention will be described.

Figure 1:
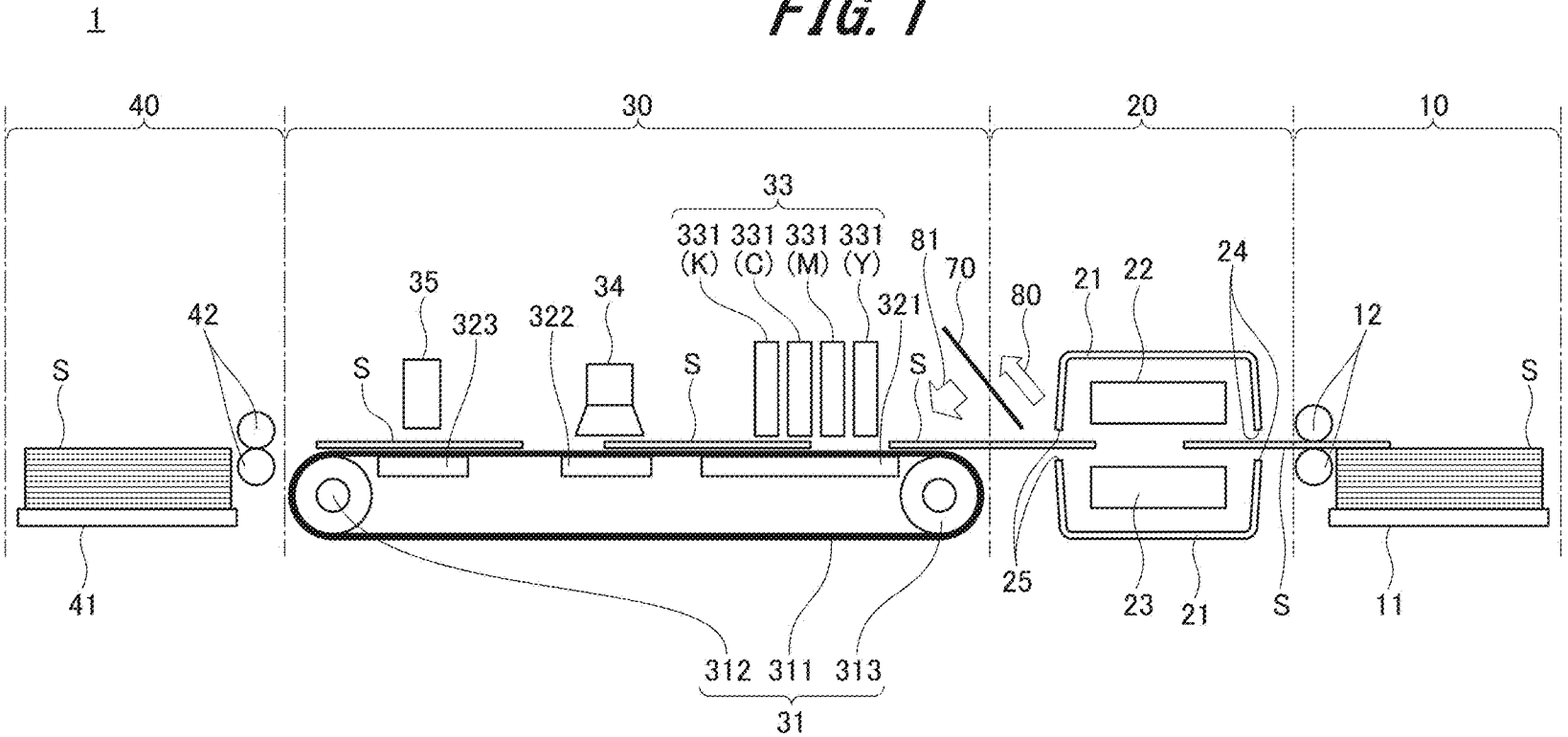
FIG. 1 is a diagram illustrating a rough configuration of an image-forming apparatus of a first embodiment.

FIG. 1 illustrates a rough schematic diagram of an image-forming apparatus of a first embodiment. The image-forming apparatus 1 illustrated in FIG. 1 is provided with a recording-material supplier 10, a heating unit 20, a shielding member 70, an image-former 30, a recording-material discharger 40, and an unshown controller 50 (see FIG. 3). The image-forming apparatus 1 illustrated in FIG. 1 is a side view of the image-forming apparatus 1 viewed in the direction which is orthogonal to a recording-material conveyance direction. Note that, in the diagram, flows of air in the heating unit 20 and the image-former 30 are illustrated by arrows.

[Recording-Material Supplier]

The recording-material supplier 10 is provided with a placement tray 11, a sending roller 12, etc. The recording-material supplier 10 stocks recording materials S on the placement tray 11, drives the sending roller 12 at appropriate timing for carrying out image formation, and sequentially supplies the recording materials S to the heating unit 20.

The placement tray 11 is a plate-like member on which the recording materials S can be stacked and placed and sends the recording materials S, which are placed on an uppermost part thereof, to the heating unit 20. The recording materials S placed on the placement tray 11 are not particularly limited, and examples of the recording materials S include films, acrylic plates, plates of resin such as PET, paper sheets, heavy paper, and cardboard materials. The placement tray 11 can be moved in the vertical direction. In this case, the position thereof is maintained so that the uppermost recording material S is retained at a position for sending to the heating unit 20 depending on the total weight, etc. of the recording materials S placed thereon.

The sending roller 12 pinches the recording material S from top and bottom and sends the recording material to the heating unit 20. The recording-material supplier 10 has an unshown guide member which limits the recording material S in a predetermined range in a direction (width direction) orthogonal to a sending direction (conveyance direction) in a conveyance surface of the recording material S. The sending roller 12 sends the recording material S to an appropriate position and direction.

[Heating Unit]

Figure 3:
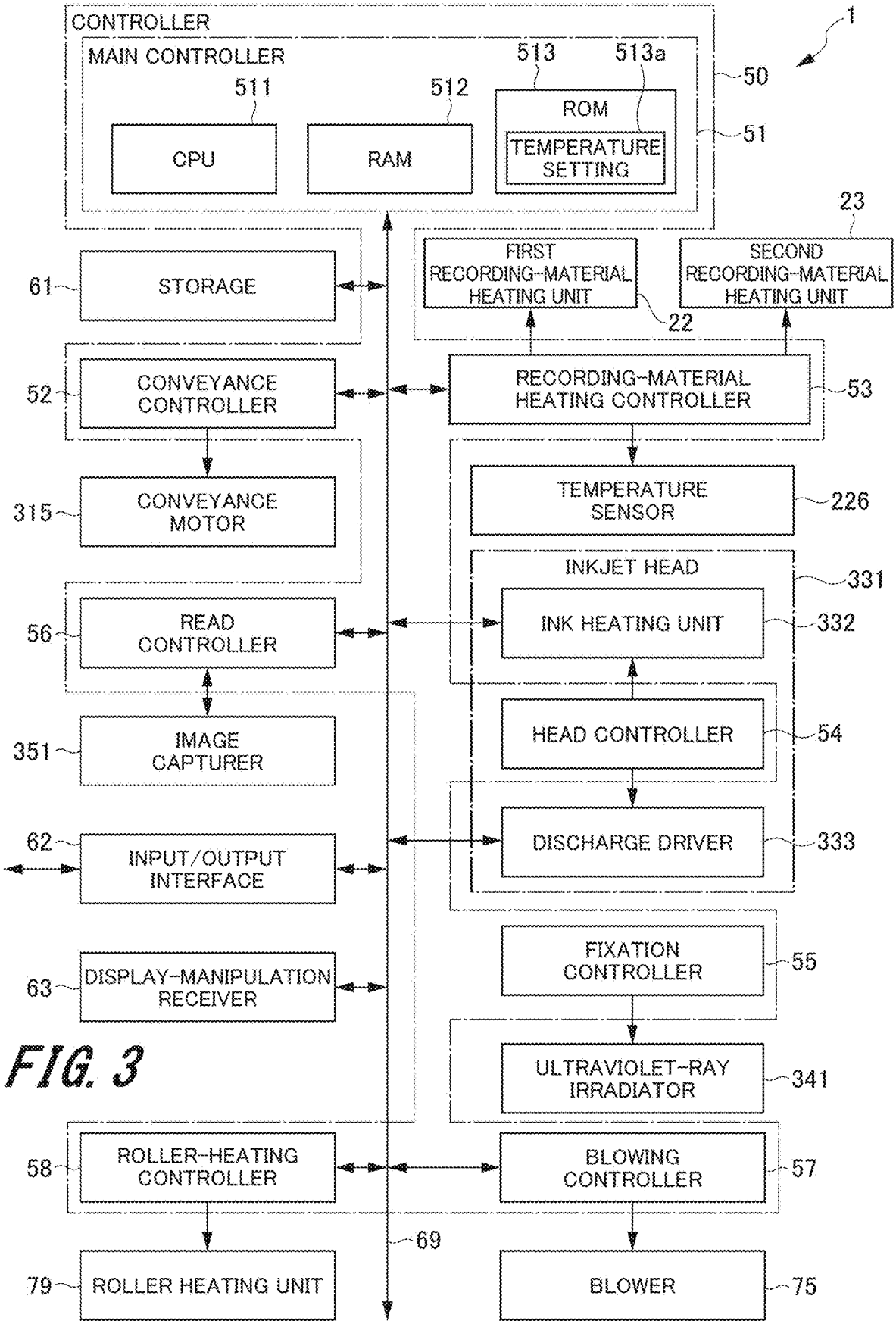
FIG. 3 is a block diagram illustrating a main configuration of the image-forming apparatus.

The heating unit 20 has a first recording-material heating unit 22, which heats an image-formation-surface side of the conveyed recording material S, and a second recording-material heating unit 23, which heats a back-surface side of the recording material S. Also, the heating unit 20 has a chassis 21, which covers the first recording-material heating unit 22 and the second recording-material heating unit 23. Also, the heating unit 20 is provided with an unshown temperature sensor 226 (FIG. 3). The temperature sensor 226 measures the temperature of the air in the chassis 21 and outputs the temperature to the controller 50 (FIG. 3). As the temperature sensor 226, a conventionally known semiconductor temperature sensor or the like can be used.

(Chassis)

The chassis 21 is a member which covers the first recording-material heating unit 22 and the second recording-material heating unit 23 and retains interior air. In the chassis 21, a recording-material inlet 24, which is a slit-like opening which allows passage of the recording materials S, is provided at an upstream-side end (receiving end) in the conveyance direction of the recording material S. Also, in the chassis 21, a recording-material outlet 25, which is a slit-like opening which allows passage of the recording materials S, is provided at a downstream-side end (sending end) in the conveyance direction of the recording material S.

The part of the chassis 21 except for the recording-material inlet 24 and the recording-material outlet 25 is preferred to be sealed. As a result, inflow of air into the chassis 21 is restricted. Also, the chassis 21 is not particularly limited to, but can be configured to further restrict in and out of heat by using a known member which has high thermal insulation performance. The interior of the chassis 21 may or may not be visible.

(First Recording-Material Heating Unit, Second Recording-Material Heating Unit)

The first recording-material heating unit 22 and the second recording-material heating unit 23 heats, without contact, the recording material S which passes through the space between the first recording-material heating unit 22 and the second recording-material heating unit 23. The first recording-material heating unit 22 and the second recording-material heating unit 23 are not particularly limited as long as the recording material S can be heated without contact, and, for example, contactless heating apparatuses such as sheathed heaters, carbon heaters, and cartridge heaters can be applied.

An object of heating of the recording material S in the heating unit 20 is for controlling the state of ink after landing on the recording material S and to control the temperature of the image formation surface of the recording material S. Therefore, in the heating unit 20, the recording material S is heated so that an appropriate temperature is obtained when the ink lands thereon. Based on the temperature of the interior air of the chassis 21 measured by the temperature sensor 226 (FIG. 3), output of the heating unit 20 is controlled by the controller 50 (FIG. 3).

The first recording-material heating unit 22 and the second recording-material heating unit 23 are independently controlled by the controller 50 (FIG. 3). By independently controlling the first recording-material heating unit 22 and the second recording-material heating unit 23, the image formation surface and the back surface of the recording material S can be heated to different temperatures, respectively. Particularly, the temperature of the back-surface side of the recording material S is set to a temperature which is different from that of the image formation surface in some cases in consideration of heat transfer of the recording material S for temperature control of the image formation surface.

In this manner, the temperature of the image formation surface of the recording material S can be controlled with higher accuracy by independently controlling the output of the first recording-material heating unit and the output of the second recording-material heating unit by the controller 50.

[Image-Former]

The image-former 30 is provided in a downstream side of the heating unit 20 in the conveyance direction of the recording material S. The image-former 30 discharges and fixes ink onto the surface of the recording material S, which has been conveyed from the heating unit 20, to form an image, and sends the recording material S, on which the ink is fixed, to the recording-material discharger 40. The image-former 30 is provided with a conveyer 31, supporters 321, 322, and 323, an image-formation operator 33, a fixer 34, a reader 35, etc.

The conveyer 31 has a conveyance belt 311, a drive roller 312, a driven roller 313, etc. The conveyance belt 311 is an endless belt-like member, which is suspended between the drive roller 312 and the driven roller 313 and is longer than the recording material S. The conveyance belt 311 is not particularly limited, but a resin or steel belt is used. The conveyance belt 311 revolves when the drive roller 312 is subjected to rotary drive by a conveyance motor 315 (see FIG. 3). As a result, the recording material S placed on an outer peripheral surface (conveyance surface) of the conveyance belt 311 is conveyed at the revolving speed of the conveyance belt 311. In this case, the single conveyance belt 311 conveys the recording material S from the heating unit 20 to the recording-material discharger 40. However, the recording material S may be conveyed by being passed by plural conveyance belts.

Each of the supporters 321, 322, and 323 is provided along the conveyance belt 311 in an inner peripheral surface side of the conveyance belt 311. The supporter 321 is provided in a range including the range corresponding to an ink discharge range of the image-formation operator 33. The supporter 322 is provided in a range including the range corresponding to an ink fixation range of the fixer 34. The supporter 323 is provided in a range including the range corresponding to a reading range of the reader 35. The supporters 321, 322, and 323 supports the recording material S, which is placed on the conveyance belt 311, by supporting the revolving conveyance belt 311 to maintain the recording material S at appropriate positions in the ink discharge range, the ink fixation range, and the reading range, respectively. Preferably, a configuration in which the supporters 321, 322, and 323 have fine pores and cause the recording material S to be more stably suctioned to the conveyance belt 311 by suctioning the recording material from the opposite side of the surface thereof which is in contact with the conveyance belt 311 can be applied.

The image-formation operator 33 has inkjet heads 331, etc. provided with nozzles. The image-formation operator 33 sequentially discharges ink from the inkjet heads 331 with respect to the recording material S, which is placed on the conveyance belt 311 and conveyed in the conveyance direction, thereby forming a two-dimensional image on the recording material S. The image-formation operator 33 can discharge ink at one time in an image formation width, which is determined in advance, with respect to the conveyed recording material S. Also, the image-formation operator 33 discharges ink within the ink discharge range from the nozzles of the inkjet heads 331 at appropriate timing.

The image-formation operator 33 illustrated in FIG. 1 is illustrating an example having the four inkjet heads 331, which discharges ink of four colors of yellow (Y), magenta (M), cyan (C), and black (K). The arrangement order of the inkjet heads 331 can be appropriately switched in the order which is preferred for image formation. Also, the image-formation operator 33 may be provided with an inkjet head(s) which discharges ink of another color(s) (including transparent ink) together with these four colors. The image-formation operator 33 uses, for example, ultraviolet-curing ink which changes phases between a sol state and a gel state by a temperature change and is fixed and cured by radiation of ultraviolet rays. The inkjet head 331 has, for example, an ink heating unit 332 (FIG. 3), which maintains the ink in a sol state having appropriate viscosity, and a discharge driver 333 (FIG. 3), which applies pressure changes to discharge the ink.

The fixer 34 irradiates the ink, which has landed on the recording material S, with ultraviolet rays in the fixation range to fix the ink. The fixer 34 is provided with an ultraviolet-ray irradiator 341 (FIG. 3). The light source of the ultraviolet rays of the fixer 34 is not particularly limited, but, for example, a light emitting diode (LED) lamp or the like which emits ultraviolet rays is used.

The reader 35 captures and reads an image on the recording material S, on which the ink has been fixed, and outputs a read signal to the controller 50 (FIG. 3). As the reader 35, for example, an image capturer 351 (FIG. 3) having a line sensor is used. The line sensor can capture an image in the width direction of the recording material S and acquires a two-dimensional image by sequentially carrying out image capturing operations along with conveyance of the recording material S. As image-capturing elements of the line sensor, CCD sensors, CMOS sensors, etc. can be used.

[Shielding Member]

The shielding member 70 is provided between the chassis 21 of the heating unit 20 and the image-formation operator 33 of the image-former 30 in the conveyance path of the recording material S. Also, the shielding member 70 is disposed above the recording material S in the image-formation-surface side in the conveyance path of the recording material S. The shielding member 70 is provided to prevent inflow of air from the chassis 21 of the heating unit 20 to the image-formation operator 33.

In the heating unit 20, the first recording-material heating unit 22 and the second recording-material heating unit 23 which are contactless with respect to the recording material S are used. Therefore, not only the recording material S, but also the air in the chassis 21 is heated. Hereinafter, the air heated in the heating unit 20 is also referred to as heated air.

Since the chassis 21 is provided with the recording-material inlet 24 and the recording-material outlet 25, the heated air flows out from the recording-material inlet 24 and the recording-material outlet 25. When the air heated in the chassis 21 flows into the image-former 30 from the downstream side of the conveyance direction of the recording material S, the inkjet heads 331 of the image-formation operator 33 are heated. Such a temperature increase of the inkjet heads 331 causes, for example, deterioration in accuracy of the landing position of the ink discharged upon image formation.

Figure 2:
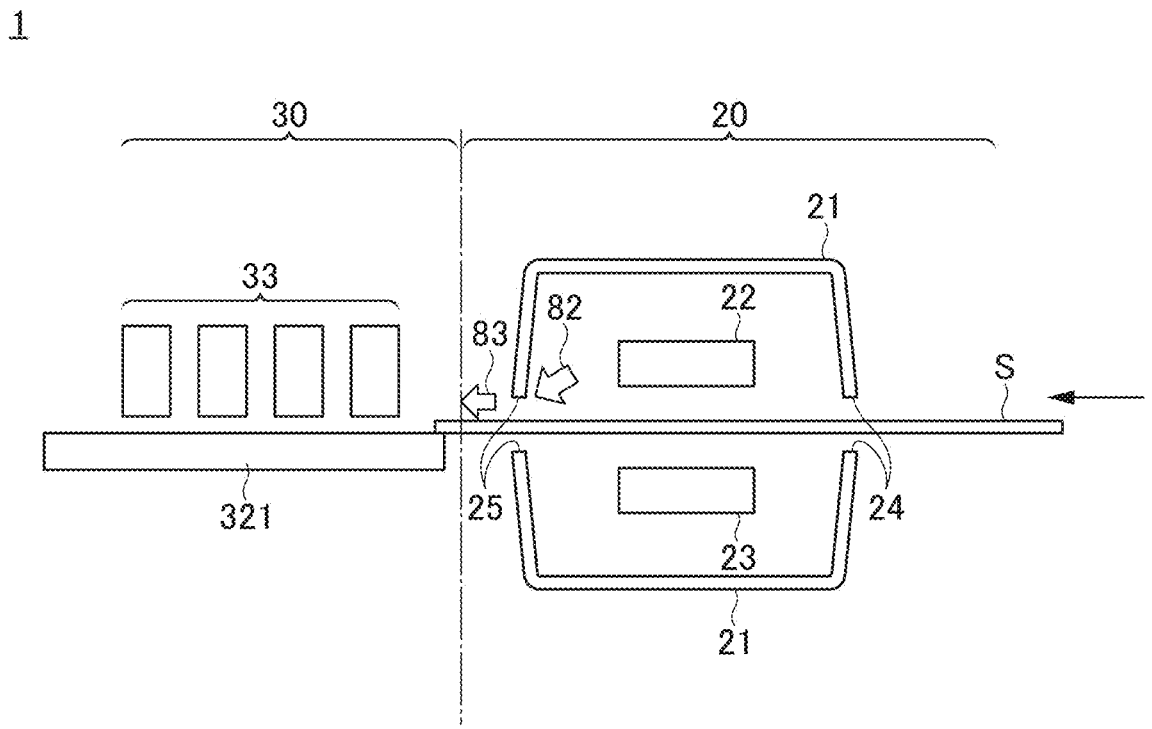
FIG. 2 is a diagram illustrating a configuration of an image-forming apparatus in which a shielding member is not provided between a heating unit and an image-former.

Particularly, when the recording material S is carried out from the chassis 21, the heated air flows out from the chassis 21 in a manner that the heated air is drawn by the conveyed recording material S. For example, a configuration in which the shielding member 70 is not provided between the heating unit 20 and the image-former 30 is illustrated in FIG. 2. FIG. 2 is a diagram illustrating part of the heating unit 20 and the image-former 30 in the image-forming apparatus 1 illustrated in FIG. 1. FIG. 2 illustrates a state in which the recording material S is being conveyed from the chassis 21 to the image-former 30. Also, FIG. 2 only illustrates the image-formation operator 33 and the supporter 321 as the image-former 30.

As illustrated in FIG. 2, the recording material S is carried out from the recording-material outlet 25. In this process, heated air 82 in the chassis 21 flows out from the recording-material outlet 25 to outside the chassis 21 in a manner that the heated air is drawn by the carry-out of the recording material S. Then, the heated air 83, which has flown out from the chassis 21, flows into the part between the image-formation operator 33 and the supporter 321.

The inkjet heads 331 of the image-formation operator 33 are heated by the heated air 83, which has flown into the image-former 30. Therefore, the temperatures of the inkjet heads 331 increase, deterioration in accuracy of the landing position of the ink discharged upon image formation, clogging of nozzles due to drying of the ink, etc. occur.

Therefore, like the image-forming apparatus 1 illustrated in FIG. 1, the shielding member 70 is provided between the chassis 21 of the heating unit 20 and the image-formation operator 33 of the image-former 30 to restrict the inflow of the heated air 80 from the chassis 21 to the image-formation operator 33.

The shape, material, etc. of the shielding member 70 is not particularly limited as long as the shielding member 70 is configured to be able to shield the heated air 80. The shielding member 70 is preferred to be formed by a member which has sufficient heat resistance with respect to the heated air 80.

The image-forming apparatus 1 illustrated in FIG. 1 is an example in which the shielding member 70 is formed by a flat-plate-like member having high rigidity. If the shielding member 70 is formed by a flat-plate-like member having high rigidity, the surface of the recording material S tends to be damaged when the shielding member 70 contacts the recording material S. Therefore, the shielding member 70 is disposed at a position that does not contact the conveyed recording material S by providing space for the recording material S to pass through between the shielding member and the conveyance path as illustrated in FIG. 1.

The shielding member 70 is disposed in the image-formation-surface side of the conveyed recording material S. The heated air 80, which flows out from the opposite side (back-surface side) of the image formation surface of the chassis 21, is shielded by the recording material S and the supporter 321 and is therefore does not easily flow into the image-formation operator 33. Therefore, the shielding member 70 is only required to be disposed in the image-formation-surface side of the recording material S.

Also, an end of the shielding member 70 in the conveyance-path side of the recording material S is obliquely disposed to be in the upstream side in the recording-material conveyance direction with respect to the end thereof in the opposite side of the conveyance-path side. In other words, the end in the conveyance-path side is disposed to be close to the heating unit 20, and the end in the opposite side of the conveyance path is disposed to be close to the image-former 30.

The heated air 80 discharged from the chassis 21 has a higher temperature than the air therearound, has a light specific gravity, and therefore tends to rise along the shielding member 70. Therefore, by disposing the shielding member 70 in the manner illustrated in FIG. 1, the heated air 80 tends to rise along the shielding member 70. As a result, the heated air 80 does not easily flow into the image-former 30 from the part between the shielding member 70 and the conveyance path. Then, unheated air 81 therearound is drawn by the conveyance of the recording material S and flows into the image-former 30.

Therefore, the image-forming apparatus 1 can restrict the inflow of the heated air 80 into the image-former 30 and restrict heating of the image-formation operator 33 by providing the shielding member 70. As a result, for example, deterioration in the accuracy of the landing position upon image formation can be restricted, and, for example, deterioration in the accuracy of image formation onto the recording material in the image-forming apparatus can be restricted.

The size of the shielding member 70 in the direction (width direction) orthogonal to the conveyance direction of the recording material S is not particularly limited. For example, the shielding member 70 is preferred to be formed to have a width equal to or larger than the recording-material outlet 25 provided in the chassis 21. Also, the shielding member 70 is preferred to be formed to have a width equal to or larger than the maximum width of the recording materials S used in the image-forming apparatus 1. Also, the shielding member 70 is preferred to be formed to have a width equal to or larger than the width in which the image-formation operator 33 is disposed in the conveyer 31 in the image-former 30.

Also, the size of the shielding member 70 above (height direction) the image formation surface of the recording material S is not particularly limited. The shielding member 70 is only required to be formed to have a height that does not easily allow inflow of the heated air into the image-formation operator 33. For example, the shielding member 70 is preferred to be formed to have a height equal to or larger than the height in which the image-formation operator 33 is disposed in the conveyer 31 in the image-former 30.

[Recording-Material Discharger]

The recording-material discharger 40 places and retains the recording materials S, which have been passed from the conveyer 31, until the recording materials are picked up by a user. The recording-material discharger 40 is provided with a discharge tray 41 and guide rollers 42. The guide rollers 42 pinch the recording material S, which has been passed from the conveyer 31, from top and bottom to carry and place the recording material on the discharge tray 41. As well as the placement tray 11, the discharge tray 41 may reduce the lowering amount of the recording material S, which has been sent by the guide rollers 42, in a vertical direction by moving up and down depending on the total weight of the recording materials S placed thereon.

[Configuration Diagram of the Image-Forming Apparatus]

FIG. 3 is a block diagram illustrating a main configuration of the image-forming apparatus 1.

As illustrated in FIG. 3, the image-forming apparatus 1 is provided with: the controller 50, a storage 61, an input/output interface 62, a display-manipulation receiver 63, a bus 69, the conveyance motor 315, the first recording-material heating unit 22, the second recording-material heating unit 23, the temperature sensor 226 (temperature measurer), the ink heating unit 332, the discharge driver 333, the ultraviolet-ray irradiator 341, the image capturer 351, a blower 75, a roller heating unit 79, etc.

Also, the controller 50 is provided with: a main controller 51, a conveyance controller 52, a recording-material heating controller 53, a head controller 54, a fixation controller 55, a read controller 56, a blowing controller 57, a roller-heating controller 58, etc.

The main controller 51 integrally controls the overall operation of the image-forming apparatus 1. The main controller 51 is provided with a central processing unit (CPU) 511, a random-access memory (RAM) 512, and a read only memory (ROM) 513. The CPU 511 carries out various arithmetic processing and carries out various control operations based on a control program, etc. The RAM 512 provides working memory space for the CPU 511 and stores temporary data. The operations of the main controller 51 (CPU 511) include a process of appropriately processing image data, which has been acquired as a target of image formation and converting the data to final data for driving the discharge driver 333.

The ROM 513 stores various control programs executed by the CPU 511 and initial settings, etc. The ROM 513 may have a rewritable/updatable flash memory or the like. In such a case, the ROM 513 can store updated or added control programs, setting data, etc. in addition to initial settings. The setting data includes the heating temperatures applied by the first recording-material heating unit 22 and the second recording-material heating unit 23 depending on the type (material), thickness, etc. of the recording material, the air volume (wind pressure) applied by the blower 75, the heating temperature applied by the roller heating unit 79, and the setting of the conveyance velocity used by the conveyer 31 depending on needs. The setting data may be stored in a non-volatile memory or the like of the storage 61.

The conveyance controller 52 controls the rotary operation of the conveyance motor 315 and carries out control related to the conveyance state of the recording material S.

The recording-material heating controller 53 controls output of the first recording-material heating unit 22 and the second recording-material heating unit 23 based on the temperature measurement data (measurement result), etc. input from the temperature sensor 226.

The head controller 54 controls the operation of the ink heating unit 332 and the discharge driver 333 and causes the ink to land on appropriate positions on the recording material S based on the image data.

The fixation controller 55 controls the operation related to ultraviolet ray irradiation by the ultraviolet-ray irradiator 341.

The read controller 56 controls the operation of the image capturer 351.

The blowing controller 57 controls the output of the air volume, wind pressure, etc. of the blower 75 by controlling the operation of the later-described blower 75.

The roller-heating controller 58 controls the output and temperature of the later-described roller heating unit 79.

The main controller 51, the conveyance controller 52, the recording-material heating controller 53, the head controller 54, the fixation controller 55, the read controller 56, the blowing controller 57, and the roller-heating controller 58 are mutually connected via the bus 69. Note that the control operation of each controller constituting the controller 50 may be integrally carried out by each component of the main controller 51. Also, each component of the controller 50 may separately have a CPU or a dedicated hardware circuit.

The storage 61 temporarily stores image data, which serves as a target of image formation, or processed data thereof. The storage 61 includes, for example, a non-volatile memory, etc.

The input/output interface 62 controls communication between the image-forming apparatus 1 and outside in accordance with communication standards. The input/output interface 62 includes, for example, a network card and can carry out transmission/reception of data with an external computer terminal, a print server, etc. via a local area network (LAN; not only wired connection, but also wireless LAN may be included). The received data includes print jobs, in other words, commands, settings, and image-formation-target image data related to image formation operations. The transmitted data includes status information, etc. of image formation operations.

The display-manipulation receiver 63 carries out display operations on a display unit based on the control of the main controller 51, receives input manipulations from outside, converts them to signals, and outputs the signals to the main controller 51. As the display unit, for example, a display device such as a liquid-crystal display, an organic electroluminescence (EL) display, etc. are used. To receive the input manipulations, a touch screen (touch sensor) or the like provided to be overlapped with the display unit is used. Also, as a component related to display, a LED lamp or the like may be provided in addition to the display unit. Also, as a component related to reception of manipulations, a numeric keypad, a push-button switch, etc. may be provided in addition to the touch screen.

2. Second Embodiment of Image-Forming Apparatus

Next, a second embodiment of an image-forming apparatus will be described.

In the above described first embodiment, the example in which the shielding member includes one flat-plate-like member is described. However, the shielding member may be configured to be a combination of plural flat-plate-like members. Therefore, as the image-forming apparatus of the second embodiment, an example provided with a shielding member including plural flat-plate-like members will be described. Note that, in the second embodiment, a configuration similar to that of the above described first embodiment can be applied except for the configuration of the shielding member. Therefore, detailed descriptions about the configuration similar to that of the above described first embodiment will be omitted.

[Shielding Member]

Figure 4:
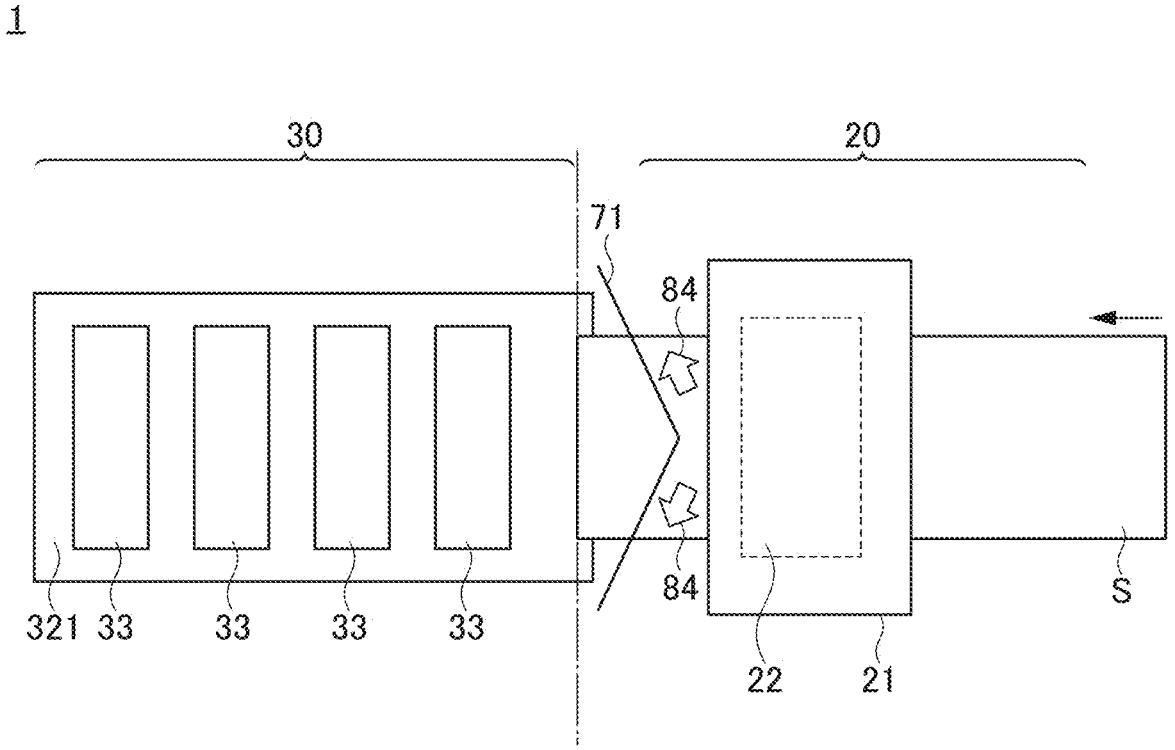
FIG. 4 is a diagram illustrating part of a heating unit, a shielding member, and an image-former of an image-forming apparatus of a second embodiment.

FIG. 4 illustrates a partial configuration of the heating unit 20, a shielding member 71, and the image-former 30 corresponding to the image-forming apparatus 1 illustrated in FIG. 1. FIG. 4 only illustrates the image-formation operators 33 and the supporter 321 as the image-former 30. In the image-forming apparatus 1, a configuration similar to that of the image-forming apparatus 1 illustrated in FIG. 1 can be applied except for the configuration of the shielding member 71.

Also, FIG. 4 is a diagram showing part of the heating unit 20, the shielding member 71, and the image-former 30 from the image-formation-surface side (upper side) of the conveyed recording material S. In FIG. 4, in the conveyance path of the recording material S between the chassis 21 of the heating unit 20 and the image-formation operators 33 of the image-former 30, the shielding member 71 is provided so as to prevent inflow of air from the chassis 21 of the heating unit 20 into the image-formation operator 33.

The shielding member 71 illustrated in FIG. 4 has a configuration in which two flat-plate-like members having high rigidity are combined. Since the shielding member 71 is formed by the flat-plate-like members having high rigidity, the shielding member is disposed with the space for allowing passage of the recording material S provided between the shielding member 71 and the conveyance path as well as the configuration illustrated in FIG. 1. Therefore, the shielding member 71 is disposed at a position at which the shielding member does not contact the conveyed recording material S.

Also, the shielding member 71 has a shape in which the flat-plate-like member is bent at a center part thereof in the width direction of the conveyance path of the recording material S and is disposed so that the center part is in the upstream side with respect to lateral ends thereof. In other words, the shielding member 71 is configured so that the center part is the closest to the heating unit 20 and that the closer the shielding member gets to the lateral end side, the more distant the shielding member is from the heating unit 20. Note that the shielding member 71 may include one bent flat-plate-like member or may include two joined flat-plate-like members.

Heated air 84 discharged from the chassis 21 flows in the direction from the heating unit 20 to the image-former 30 so as to be drawn by the conveyance of the recording material S. In this process, since the shielding member 71 has the above-described shape, the heated air 84 discharged from the chassis 21 tends to flow in the width direction of the conveyance path along the shielding member 71. Also, since the heated air 84 has higher temperature than the air therearound and has a light specific gravity, the heated air rises while flowing in the width direction along the shielding member 71. As a result, the heated air 84 does not easily flow into the image-former 30 from the part between the shielding member 71 and the conveyance path.

Therefore, inflow of the heated air 84 into the image-former 30 can be restricted by the shielding member 71, and heating of the image-formation operator 33 can be restricted. As a result, for example, deterioration in the accuracy of the landing position upon image formation can be restricted, and, for example, deterioration in the accuracy of image formation onto the recording material in the image-forming apparatus can be restricted.

Also, regarding the shielding member 71, the size in the height direction and the size in the width direction are also not particularly limited. For example, the shielding member 71 is preferred to be formed to have a width equal to or larger than the recording-material outlet 25 provided in the chassis 21. Also, the shielding member 71 is preferred to be formed to have a width equal to or larger than the maximum width of the recording materials S used in the image-forming apparatus 1. Also, the shielding member 71 is preferred to be formed to have a width equal to or larger than the width in which the image-formation operator 33 is disposed in the conveyer 31 in the image-former 30. Also, the shielding member 71 is preferred to be formed to have a height equal to or larger than the height in which the image-formation operator 33 is disposed in the conveyer 31 in the image-former 30.

3. Third Embodiment of Image-Forming Apparatus

Next, a third embodiment of an image-forming apparatus will be described.

In the above described first embodiment and the second embodiment, the example in which the flat-plate-like member is used as the shielding member has been explained. However, the shielding member is not limited to a flat-plate-like member as long as the shielding member is configured to be able to shield the heated air. Therefore, as the image-forming apparatus of the third embodiment, an example provided with a shielding member including a roller will be described. Note that, in the third embodiment, a configuration similar to that of the above described first embodiment can be applied except for the configuration of the shielding member. Therefore, detailed descriptions about the configuration similar to that of the above described first embodiment will be omitted.

[Shielding Member]

Figure 5:
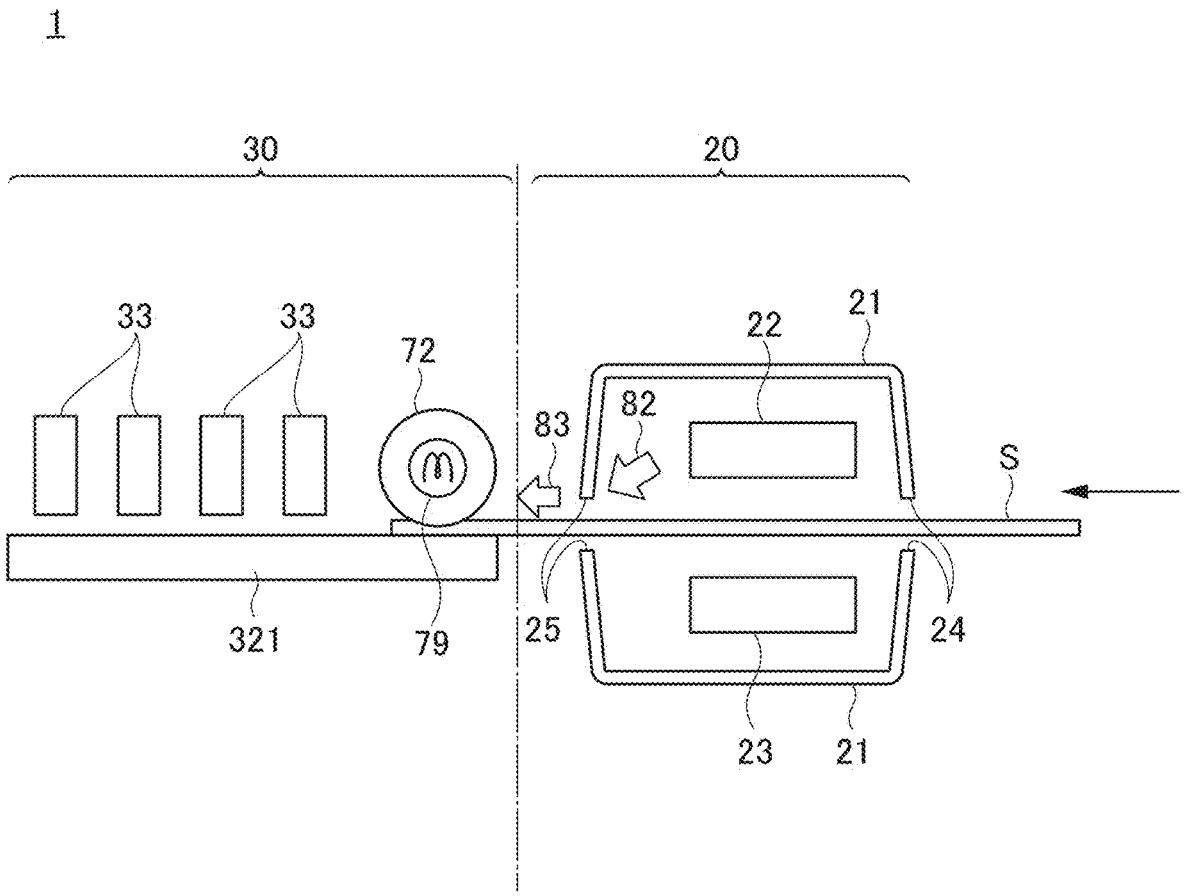
FIG. 5 is a diagram illustrating part of a heating unit, a shielding member, and an image-former of an image-forming apparatus of a third embodiment.

FIG. 5 illustrates a partial configuration of the heating unit 20, a shielding member 72, and the image-former 30 corresponding to the image-forming apparatus 1 illustrated in FIG. 1. FIG. 5 only illustrates the image-formation operators 33 and the supporter 321 as the image-former 30. In the image-forming apparatus 1, a configuration similar to that of the image-forming apparatus 1 illustrated in FIG. 1 can be applied except for the configuration of the shielding member 72.

The shielding member 72 illustrated in FIG. 5 is disposed at a position abutting the conveyed recording material S and is formed by a rotatably retained roller member. The shielding member 72 including the roller member pinches the recording material S between the shielding member and the supporter 321 and sends the recording material to the heating unit 20.

The shielding member 72 carries out rotary operation along with conveyance of the recording material S by driving of the conveyance motor 315 (FIG. 3) controlled by the conveyance controller 52 of the controller 50. As a result, the recording material S conveyed from the heating unit 20 to the shielding member 72 can be conveyed to the image-former 30.

Also, since the shielding member 72 includes the roller member and carries out rotary drive along with conveyance of the recording material S, the surface of the recording material S is not easily damaged. Therefore, as illustrated in FIG. 5, the shielding member 72 can be disposed at a position that contacts the conveyed recording material S.

The air (heated air 82) heated in the chassis 21 flows from the recording-material outlet 25 to outside the chassis 21 in a manner that the air is drawn by the conveyance of the recording material S. In this process, the heated air 83 discharged from the chassis 21 is shielded by the shielding member 72. More specifically, the shielding member 72 includes the roller member, and the recording material S is conveyed in the state in which the recording material is abutting the shielding member 72. Therefore, the passage of the heated air 83 from the part between the shielding member 72 and the recording material conveyance path (the supporter 321) can be shielded.

Therefore, the shielding member 72 can shield the inflow of the heated air 83 to the inkjet heads 331 of the image-formation operator 33 while the recording material S is conveyed.

Therefore, inflow of the heated air 83 into the image-former 30 can be restricted by the shielding member 72, and heating of the image-formation operator 33 can be restricted. As a result, for example, deterioration in the accuracy of the landing position upon image formation can be restricted, and, for example, deterioration in the accuracy of image formation onto the recording material in the image-forming apparatus can be restricted.

Also, the shielding member 72 is preferred to be provided with the roller heating unit 79, which heats the part of the roller member that contacts the recording material S, in the roller member. Output of the roller heating unit 79 is controlled by the roller-heating controller 58 (FIG. 3) of the controller 50. By heating the roller member of the shielding member 72 by the roller heating unit 79 and causing the heated shielding member 72 to abut the recording material S, the temperature adjustment of the recording material S can be carried out with higher accuracy.

Regarding the shielding member 72, the shape and the material of the roller member are not particularly limited. The shielding member 72 is preferred to use, as the roller member, a flexible member which can convey the recording material S and does not damage conveyance of the recording material S. Also, regarding the shielding member 72, the roller member is preferred to use a material which has heat resistance with respect to heating of the roller heating unit 79 and is excellent in heat conductivity to the recording material S.

Regarding the shielding member 72, the size of the roller member in the height direction and the size thereof in the width direction are also not particularly limited. For example, the roller member constituting the shielding member 72 is preferred to be formed to have a width equal to or larger than the recording-material outlet 25 provided in the chassis 21. Also, the roller member is preferred to be formed to have a width equal to or larger than the maximum width of the recording materials S used in the image-forming apparatus 1. Also, the roller member is preferred to be formed to have a width equal to or larger than the width in which the image-formation operator 33 is disposed in the conveyer 31 in the image-former 30. Also, the roller member constituting the shielding member 72 is preferred to be formed to have a height equal to or larger than the height in which the image-formation operator 33 is disposed in the conveyer 31 in the image-former 30.

4. Fourth Embodiment of Image-Forming Apparatus

Next, a fourth embodiment of an image-forming apparatus will be described.

In the above described first embodiment and the second embodiment, the example in which the flat-plate-like member having high rigidity is used as the shielding member has been explained. However, the shielding member is not limited to a flat-plate-like member having high rigidity as long as the shielding member is configured to be able to shield the heated air. Therefore, as the image-forming apparatus of the fourth embodiment, an example provided with a shielding member including a flexible member will be described. Note that, in the fourth embodiment, a configuration similar to that of the above described first embodiment can be applied except for the configuration of the shielding member. Therefore, detailed descriptions about the configuration similar to that of the above described first embodiment will be omitted.

[Shielding Member]

Figure 6:
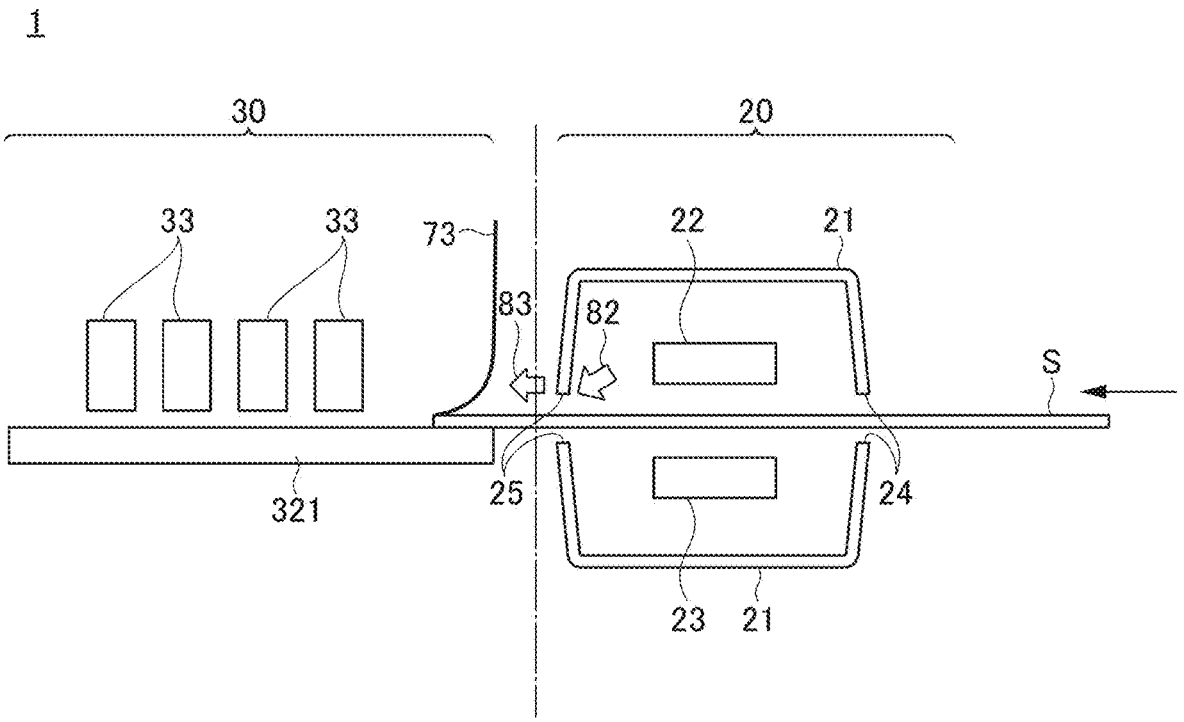
FIG. 6 is a diagram illustrating part of a heating unit, a shielding member, and an image-former of an image-forming apparatus of a fourth embodiment.

FIG. 6 illustrates a partial configuration of the heating unit 20, a shielding member 73, and the image-former 30 corresponding to the image-forming apparatus 1 illustrated in FIG. 1. FIG. 6 only illustrates the image-formation operators 33 and the supporter 321 as the image-former 30. In the image-forming apparatus 1, a configuration similar to that of the image-forming apparatus 1 illustrated in FIG. 1 can be applied except for the configuration of the shielding member 73.

Also, FIG. 6 is a side view of the image-forming apparatus 1 illustrating part of the heating unit 20, the shielding member 73, and the image-former 30 from the direction orthogonal to the conveyance direction of the conveyed recording material S. In FIG. 6, in the conveyance path of the recording material S between the chassis 21 of the heating unit 20 and the image-formation operators 33 of the image-former 30, the shielding member 73 is provided so as to prevent inflow of air from the chassis 21 of the heating unit 20 into the image-formation operator 33.

The shielding member 73 illustrated in FIG. 6 is formed by a highly flexible member (flexible member). Since the shielding member 73 is formed by the flexible member, different from the configuration illustrated in FIG. 1, the surface of the recording material S is not easily damaged even when the shielding member contacts the conveyed recording material S. Therefore, the shielding member 73 can be disposed at a position that contacts the conveyed recording material S.

The air (heated air 82) heated in the chassis 21 flows from the recording-material outlet 25 to outside the chassis 21 in a manner that the air is drawn by the conveyance of the recording material S. In this process, the heated air 83 discharged from the chassis 21 is shielded by the shielding member 73. Therefore, the shielding member 73 can shield the inflow of the heated air 83 to the inkjet heads 331 of the image-formation operator 33.

Also, a conveyance-path side end of the shielding member 73 is retained in a state in which the end contacts the supporter 321 and is bent in the conveyance-direction downstream side. By retaining the shielding member 73 in this state, the shielding member 73 can easily abut the conveyed recording material S. Since the contact area between the shielding member 73 and the recording material S increases, the passage of the heated air 83 from the part between the shielding member 73 and the recording material conveyance path (supporter 321) can be shielded.

Also, since the shielding member 72 bends, the stress applied to the recording material S at the part where the recording material S starts contacting the shielding member 72 tends to be lowered, and the damage onto the surface of the recording material S can be further reduced.

Therefore, inflow of the heated air 83 into the image-former 30 can be restricted by the shielding member 73, and heating of the image-formation operator 33 can be restricted. As a result, for example, deterioration in the accuracy of the landing position upon image formation can be restricted, and, for example, deterioration in the accuracy of image formation onto the recording material in the image-forming apparatus can be restricted.

Also, regarding the shielding member 73, the size in the height direction and the size in the width direction are also not particularly limited. For example, the shielding member 73 is preferred to be formed to have a width equal to or larger than the recording-material outlet 25 provided in the chassis 21. Also, the shielding member 73 is preferred to be formed to have a width equal to or larger than the maximum width of the recording materials S used in the image-forming apparatus 1. Also, the shielding member 73 is preferred to be formed to have a width equal to or larger than the width in which the image-formation operator 33 is disposed in the conveyer 31 in the image-former 30. Also, the shielding member 73 is preferred to be formed to have a height equal to or larger than the height in which the image-formation operator 33 is disposed in the conveyer 31 in the image-former 30.

5. Fifth Embodiment of Image-Forming Apparatus

Next, a fifth embodiment of an image-forming apparatus will be described.

In the above described first embodiment to the fourth embodiment, the configuration which shields the heated air by the shielding member has been described. However, the shielding member may be configured to discharge the heated air to outside in addition to shielding the heated air. Therefore, as the image-forming apparatus of the fifth embodiment, an example provided with a blower for exhausting the heated air together with a plate-like member which shields the heated air will be described. Note that, in the fifth embodiment, a configuration similar to that of the above described first embodiment can be applied except for the configuration of the shielding member. Therefore, detailed descriptions about the configuration similar to that of the above described first embodiment will be omitted.

[Shielding Member]

Figure 7:
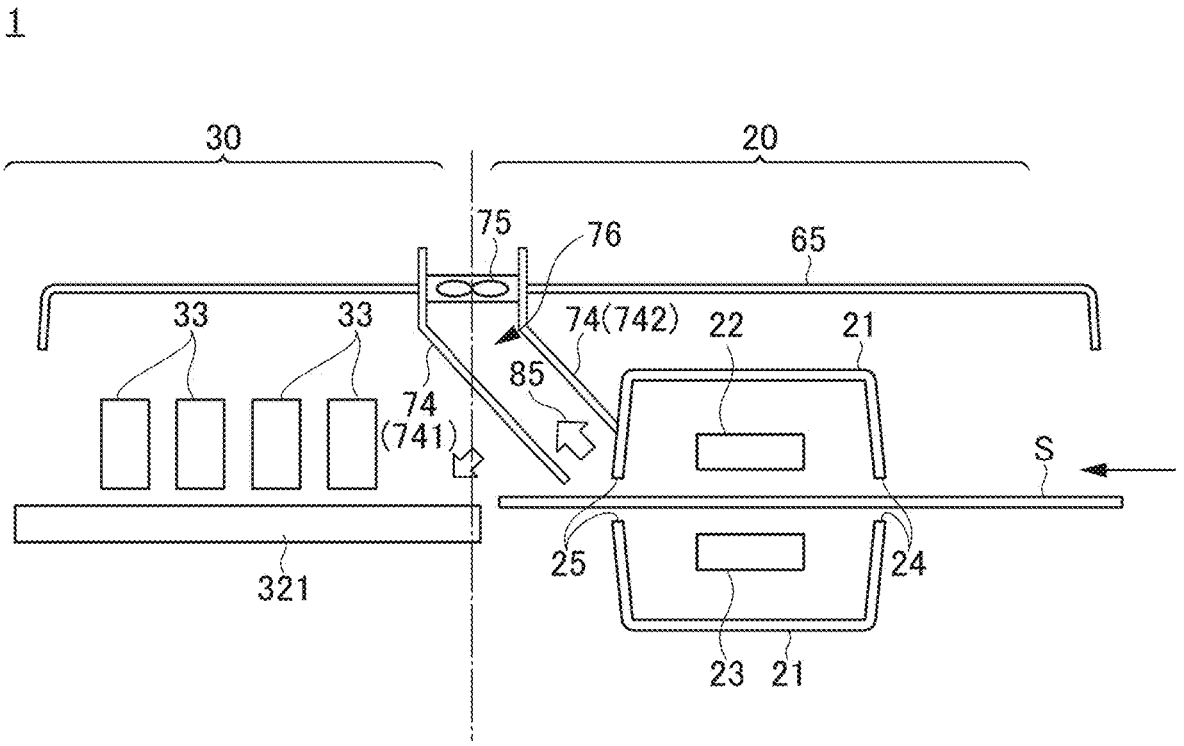
FIG. 7 is a diagram illustrating part of a heating unit, a shielding member, and an image-former of an image-forming apparatus of a fifth embodiment.

FIG. 7 illustrates a partial configuration of the heating unit 20, a shielding member 74, a blower 75, and the image-former 30 corresponding to the image-forming apparatus 1 illustrated in FIG. 1. FIG. 7 only illustrates the image-formation operators 33 and the supporter 321 as the image-former 30.

Also, FIG. 7 is a side view of the image-forming apparatus 1 illustrating part of the heating unit 20, the shielding member 74, the blower 75, and the image-former 30 from the direction orthogonal to the conveyance direction of the conveyed recording material S. In FIG. 7, in the conveyance path of the recording material S between the chassis 21 of the heating unit 20 and the image-formation operators 33 of the image-former 30, the shielding member 74 is provided so as to prevent inflow of air from the chassis 21 of the heating unit 20 into the image-formation operator 33.

The shielding member 74 includes plural flat-plate-like members having high rigidity. Also, the shielding member 74 has a flat-plate-like first shielding member 741 in which an end in the conveyance-path side of the recording material S is obliquely disposed to be in the upstream side in the recording-material conveyance direction with respect to the end thereof in the opposite side of the conveyance-path side. Also, the shielding member 74 has a flat-plate-like second shielding member 742 disposed at a position opposed to the first shielding member 741 in the upstream side in the conveyance direction of the recording material S of the first shielding member 741. Furthermore, the shielding member 74 has an unshown third shielding member and a fourth shielding member, which are disposed in the direction parallel to the conveyance direction of the recording material S and connect width-direction ends of the first shielding member 741 and the second shielding member 742.

In this manner, the shielding member 74 includes the first shielding member 741, the second shielding member 742, the third shielding member, and the fourth shielding member in the downstream side of the chassis 21 and forms a gas channel 76 into which the heated air 85, which is discharged from the recording-material outlet 25, flows. The gas channel 76 is a tubular member which has openings in a vicinity of the downstream side of the recording-material outlet 25 of the chassis 21 and outside of an exterior body 65 and is surrounded by the shielding member 74. Note that as long as the gas channel 76 can be formed in the downstream side of the chassis 21 by the shielding member 74, the gas channel 76 is not limited to the above-described shape. A member other than a flat plate like member may be used as the shielding member 74, and the shape of the gas channel 76 may be another shape such as a polygonal shape or a circular shape.

The blower 75 is provided in the gas channel 76. As the blower 75, for example, a blower apparatus, an air compressor, or the like can be used. The blower 75 controls drive and output by the blowing controller 57 of the controller 50 (FIG. 3). When the blowing controller 57 controls the drive and output of the blower 75, the flow rate and the air pressure of the heated air 85, which passes in the gas channel 76, can be controlled. Then, by driving the blower 75, the heated air 85 can be drawn into the gas channel 76, the heated air 85 can be moved in the gas channel 76, and the heated air 85 can be exhausted to outside of the exterior body 65.

Also, since the shielding member 74 is formed by the flat-plate-like members having high rigidity, the shielding member is disposed with the space for allowing passage of the recording material S provided between the shielding member 74 and the conveyance path as well as the configuration illustrated in FIG. 1. Therefore, the shielding member 74 is disposed at a position at which the shielding member does not contact the conveyed recording material S.

In the gas channel 76 of the shielding member 74, an end in the conveyance-path side is obliquely disposed to be in the upstream side in the recording-material conveyance direction with respect to the end thereof in the opposite side of the conveyance-path side. In other words, the end in the conveyance-path side of the gas channel 76 is disposed to be close to the heating unit 20, and the end in the opposite side of the conveyance path is disposed to be close to the image-former 30.

The gas channel 76 allows inflow of the heated air 85 from the opening in the side of the recording-material outlet 25 and discharges the heated air 85 from the opening outside the exterior body 65.

Heated air 85 discharged from the chassis 21 flows in the direction from the heating unit 20 to the image-former 30 so as to be drawn by the conveyance of the recording material S. In this process, since the shielding member 74 forms the gas channel 76 having the above-described shape, the heated air 85 discharged from the chassis 21 tends to flow into the gas channel 76 along the shielding member 74. The heated air 85 has a higher temperature than the air therearound, has a light specific gravity, and therefore tends to rise in the gas channel 76 along the shielding member 74.

Furthermore, by driving the blower 75 provided in the gas channel 76, the heated air 85 discharged from the chassis 21 can be drawn into the gas channel 76. Then, the heated air 85 drawn by the gas channel 76 can be exhausted to outside of the exterior body 65 through the gas channel 76.

As a result, the heated air 85 does not easily flow into the image-former 30 from the part between the shielding member 74 and the conveyance path.

Therefore, inflow of the heated air 85 into the image-former 30 can be restricted by the shielding member 74 and the blower 75, and heating of the image-formation operator 33 can be restricted. As a result, deterioration in the accuracy of the landing position upon image formation can be restricted, and deterioration in the accuracy of image formation onto the recording material in the image-forming apparatus can be restricted.

Regarding the gas channel 76 formed by the shielding member 74, the size in the height direction and the size in the width direction are also not particularly limited. For example, the gas channel 76 is preferred to be formed to have a width equal to or larger than the recording-material outlet 25 provided in the chassis 21. Also, the gas channel 76 is preferred to be formed to have a width equal to or larger than the maximum width of the recording materials S used in the image-forming apparatus 1. Also, the gas channel 76 is preferred to be formed to have a width equal to or larger than the width in which the image-formation operator 33 is disposed in the conveyer 31 in the image-former 30.

6. Sixth Embodiment of Image-Forming Apparatus

Next, a sixth embodiment of an image-forming apparatus will be described.

In the above described fifth embodiment, the configuration in which the heated air is shielded and exhausted to outside by the shielding member and the blower has been described. However, a configuration in which the heated air is not exhausted to outside the image-forming apparatus may be used. Therefore, as the image-forming apparatus of the sixth embodiment, a configuration in which heated air from the blower is circulated will be described in addition to the shielding member which shields the heated air. Note that, in the sixth embodiment, a configuration similar to that of the above described first embodiment and the fifth embodiment can be applied except for the configuration of the shielding member. Therefore, detailed descriptions about the configuration similar to that of the above described first embodiment and the fifth embodiment will be omitted.

[Shielding Member]

Figure 8:
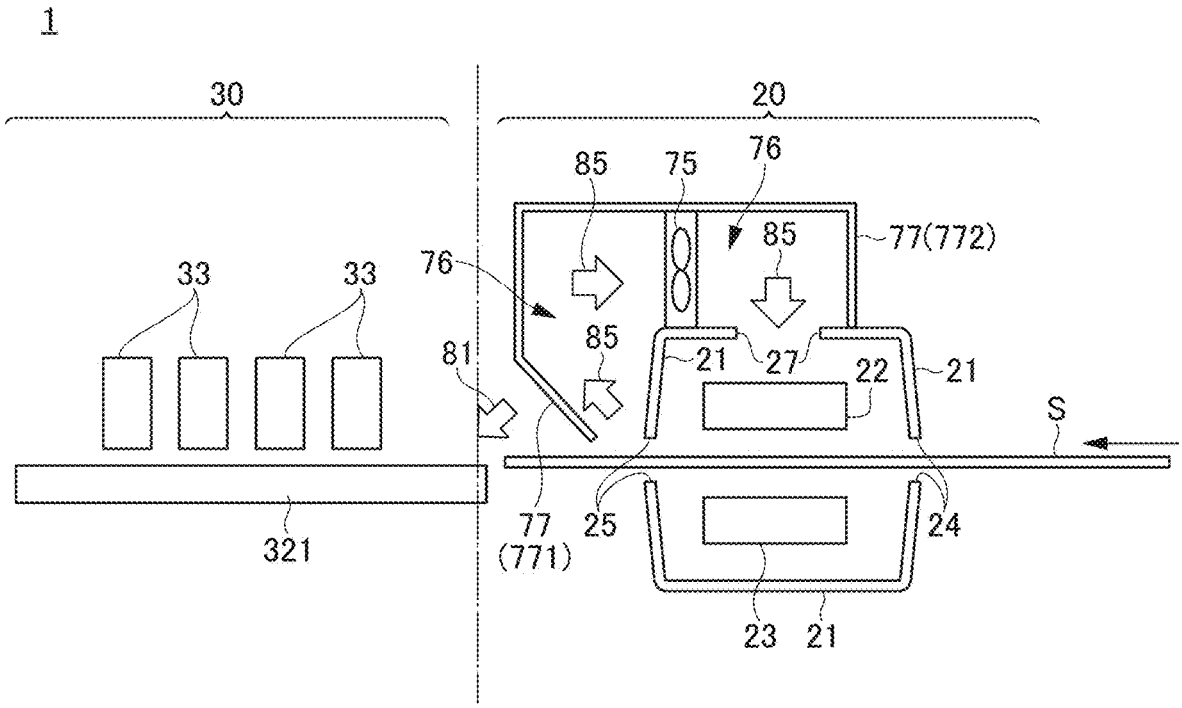
FIG. 8 is a diagram illustrating part of a heating unit, a shielding member, and an image-former of an image-forming apparatus of a sixth embodiment.

FIG. 8 illustrates a partial configuration of the heating unit 20, a shielding member 77, a blower 75, and the image-former 30 corresponding to the image-forming apparatus 1 illustrated in FIG. 1. FIG. 8 only illustrates the image-formation operators 33 and the supporter 321 as the image-former 30.

Also, FIG. 8 is a side view of the image-forming apparatus 1 illustrating part of the heating unit 20, the shielding member 77, the blower 75, and the image-former 30 from the direction orthogonal to the conveyance direction of the conveyed recording material S. In FIG. 8, in the conveyance path of the recording material S between the chassis 21 of the heating unit 20 and the image-formation operators 33 of the image-former 30, the shielding member 77 is provided so as to prevent inflow of air from the chassis 21 of the heating unit 20 into the image-formation operator 33.

The shielding member 77 includes plural flat-plate-like members having high rigidity. Also, the shielding member 77 has a flat-plate-like first shielding member 771 in which an end in the conveyance-path side of the recording material S is obliquely disposed to be in the upstream side in the recording-material conveyance direction with respect to the end thereof in the opposite side of the conveyance-path side. Also, the shielding member 77 has a second shielding member 772, which is connected to the first shielding member 771 and covers part of the chassis 21. The second shielding member 772 continuously covers from an upper end of the first shielding member 771 to the upper surface side of the chassis 21. Furthermore, the second shielding member 772 continuously covers from a lateral end of the first shielding member 771 to the upper surface or the lateral surface of the chassis 21.

Also, the chassis 21 is provided with a gas inflow opening 27 from which the heated air 85 from the gas channel 76 is provided in the upper surface side. The gas inflow opening 27 is provided at a position different from the positions of the recording-material inlet 24 and the recording-material outlet 25. The gas channel 76 has openings in a downstream-side vicinity of the recording-material outlet 25 of the chassis 21 and in the upper surface side of the chassis 21.

Therefore, the gas channel 76 which includes the shielding member 77 (the first shielding member 771 and the second shielding member 772) and the chassis 21 is formed, wherein the heated air 85 discharged from the recording-material outlet 25 flows into the gas channel 76. The gas channel 76 is a tubular member surrounded by the shielding member 77 and the chassis 21. Note that as long as the gas channel 76 can be formed in the downstream side of the chassis 21 by the shielding member 77, the gas channel 76 is not limited to the above-described shape. A member other than a flat plate like member may be used as the shielding member 77, and the shape of the gas channel 76 may be another shape such as a polygonal shape or a circular shape.

Also, since the shielding member 77 is formed by the flat-plate-like members having high rigidity, the shielding member is disposed with the space for allowing passage of the recording material S provided between the shielding member 77 and the conveyance path as well as the configuration illustrated in FIG. 1. Therefore, the shielding member 77 is disposed at a position at which the shielding member does not contact the conveyed recording material S.

An end of the first shielding member 771 of the shielding member 77 in the conveyance-path side of the recording material S is obliquely disposed to be in the upstream side in the recording-material conveyance direction with respect to the end thereof in the opposite side of the conveyance-path side. In other words, the end in the conveyance-path side of the gas channel 76 is disposed to be close to the heating unit 20, and the end in the opposite side of the conveyance path is disposed to be close to the image-former 30.

Also, the blower 75 is provided in the gas channel 76. When the blower 75 is driven, the heated air 85 which has flowed in from the recording-material outlet 25 of the chassis 21 is introduced into the gas channel 76. Then, as a result of driving of the blower 75, the heated air 85, which has flowed into the gas channel 76, moves in the gas channel 76, passes through the blower 75, and is introduced into the chassis 21 from the gas channel 76.

As a result, the heated air 85 does not easily flow into the image-former 30 from the part between the shielding member 77 and the conveyance path.

Therefore, inflow of the heated air 85 into the image-former 30 can be restricted by the shielding member 77 and the blower 75, and heating of the image-formation operator 33 can be restricted. As a result, deterioration in the accuracy of the landing position upon image formation can be restricted, and deterioration in the accuracy of image formation onto the recording material in the image-forming apparatus can be restricted.

Furthermore, since the heated air 85 circulates in the chassis 21 and the gas channel 76, the temperature in the chassis 21 tends to be stabilized compared with the case in which air is introduced from outside the chassis 21. Therefore, the heating stability of the recording material in the heating unit 20 can be easily improved.

7. Seventh Embodiment of Image-Forming Apparatus

Next, a seventh embodiment of an image-forming apparatus will be described.

In the above described sixth embodiment, the configuration which shields the heated air by the shielding member and the blower and directly introduces the heated air into the chassis of the heating unit has been described. However, a configuration in which the heated air is not directly introduced into the chassis may be also used. Therefore, as the image-forming apparatus of the seventh embodiment, a configuration in which heated air from the blower is introduced to the upstream side of the chassis will be described in addition to the shielding member which shields the heated air. Note that, in the seventh embodiment, a configuration similar to that of the above described first embodiment, the fifth embodiment, and the sixth embodiment can be applied except for the configuration of the shielding member. Therefore, detailed descriptions about the configuration similar to that of the above described first embodiment, the fifth embodiment, and the sixth embodiment will be omitted.

[Shielding Member]

Figure 9:
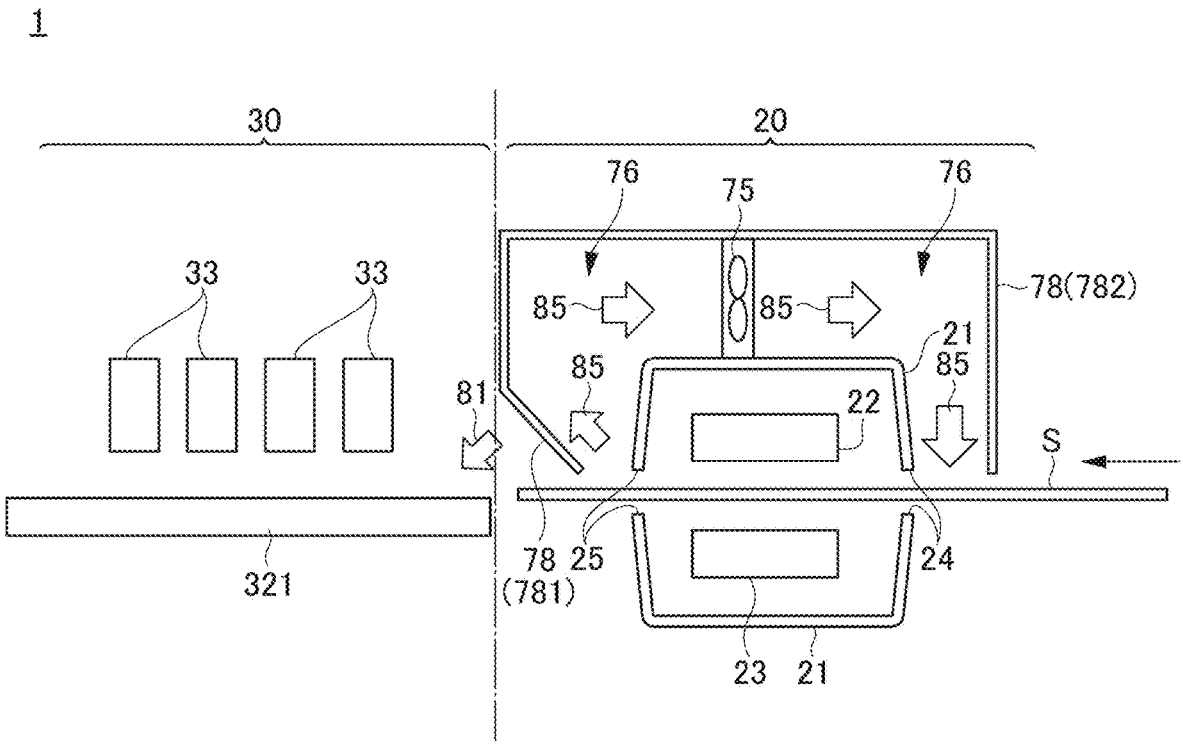
FIG. 9 is a diagram illustrating part of a heating unit, a shielding member, and an image-former of an image-forming apparatus of a seventh embodiment.

FIG. 9 illustrates a partial configuration of the heating unit 20, a shielding member 78, a blower 75, and the image-former 30 corresponding to the image-forming apparatus 1 illustrated in FIG. 1. FIG. 9 only illustrates the image-formation operators 33 and the supporter 321 as the image-former 30.

Also, FIG. 9 is a side view of the image-forming apparatus 1 illustrating part of the heating unit 20, the shielding member 78, the blower 75, and the image-former 30 from the direction orthogonal to the conveyance direction of the conveyed recording material S. In FIG. 9, in the conveyance path of the recording material S between the chassis 21 of the heating unit 20 and the image-formation operators 33 of the image-former 30, the shielding member 78 is provided so as to prevent inflow of air from the chassis 21 of the heating unit 20 into the image-formation operator 33.

The shielding member 78 includes plural flat-plate-like members having high rigidity. Also, the shielding member 78 has a flat-plate-like first shielding member 781 in which an end in the conveyance-path side of the recording material S is obliquely disposed to be in the upstream side in the recording-material conveyance direction with respect to the end thereof in the opposite side of the conveyance-path side. Furthermore, the shielding member 78 has a second shielding member 782, which is connected to the first shielding member 781 and covers the entirety of the chassis 21 together with the first shielding member 781. The second shielding member 782 continuously covers the upper surface and the lateral surfaces from the upper end of the first shielding member 781 to the upstream side in the conveyance direction of the recording material S of the chassis 21.

Therefore, the gas channel 76 which includes the shielding member 78 (the first shielding member 781 and the second shielding member 782) and the chassis 21 is formed, wherein the heated air 85 discharged from the recording-material outlet 25 flows into the gas channel 76. The gas channel 76 is a tubular member surrounded by the shielding member 78 and the chassis 21.

The gas channel 76 has openings in a downstream-side vicinity of the recording-material outlet 25 of the chassis 21 and in an upstream-side vicinity of the recording-material inlet 24 of the chassis 21.

Note that as long as the gas channel 76 can be formed in the downstream side of the chassis 21 by the shielding member 78, the gas channel 76 is not limited to the above-described shape. A member other than a flat plate like member may be used as the shielding member 78, and the shape of the gas channel 76 may be another shape such as a polygonal shape or a circular shape.

The shielding member 78 is formed by a flat-plate-like member having high rigidity. Therefore, as well as the configuration illustrated in FIG. 1, the shielding member 78 is disposed at a position which does not contact the conveyed recording material S, and space through which the recording material S passes is provided between the first shielding member 781 and the conveyance path. Also, in the shielding member 78, an end of the second shielding member 782 in the upstream side in the conveyance direction of the recording material S is disposed at a position which does not contact the conveyed recording material S, and the space through which the recording material S passes is provided between the second shielding member 782 and the conveyance path.

Therefore, the recording material S passes the part between the end of the second shielding member 782 and the conveyance path and is conveyed into the chassis 21 from the recording-material inlet 24. Then, the recording material S heated in the chassis 21 is carried out from the recording-material outlet 25, passes through the part between the first shielding member 781 and the conveyance path, and is conveyed to the image-former 30.

An end of the first shielding member 781 of the shielding member 78 in the conveyance-path side of the recording material S is obliquely disposed to be in the upstream side in the recording-material conveyance direction with respect to the end thereof in the opposite side of the conveyance-path side. In other words, the end in the conveyance-path side of the gas channel 76 is disposed to be close to the heating unit 20, and the end in the opposite side of the conveyance path is disposed to be close to the image-former 30.

Also, the blower 75 is provided in the gas channel 76. When the blower 75 is driven, the heated air 85 which has flowed in from the recording-material outlet 25 of the chassis 21 is introduced into the gas channel 76. Then, as a result of driving of the blower 75, the heated air 85, which has flowed into the gas channel 76, moves in the gas channel 76, and passes through the blower 75, and the heated air 85 is introduced to the upstream side of the recording-material inlet 24 of the chassis 21 from the gas channel 76.

As a result, the heated air 85 does not easily flow into the image-former 30 from the part between the shielding member 78 and the conveyance path.

Therefore, inflow of the heated air 85 into the image-former 30 can be restricted by the shielding member 78 and the blower 75, and heating of the image-formation operator 33 can be restricted. As a result, deterioration in the accuracy of the landing position upon image formation can be restricted, and deterioration in the accuracy of image formation onto the recording material in the image-forming apparatus can be restricted.

Furthermore, since the heated air 85 circulates in the chassis 21 and the gas channel 76, the temperature in the chassis 21 tends to be stabilized compared with the case in which air is introduced from outside the chassis 21. Therefore, the heating stability of the recording material in the heating unit 20 can be easily improved.

Note that the present invention is not limited to the configuration described in the above-described embodiment example, and various modifications and changes can be made without departing from the configuration of the present invention.

Although embodiments of the present invention have been described and illustrated in detail, the disclosed embodiments are made for purposes of illustration and example only and not limitation. The scope of the present invention should be interpreted by terms of the appended claims.

DESCRIPTION OF REFERENCE NUMERALS

1 . . . image-forming apparatus
2 . . . cited document
10 . . . recording-material supplier
11 . . . placement tray
12 . . . sending roller
20 . . . heating unit
21 . . . chassis
22 . . . first recording-material heating unit
23 . . . second recording-material heating unit
24 . . . recording-material inlet
25 . . . recording-material outlet
27 . . . gas inflow opening
30 . . . image-former
31 . . . conveyer
33 . . . image-formation operator
34 . . . fixer
35 . . . reader
40 . . . recording-material discharger
41 . . . discharge tray
42 . . . guide roller
50 . . . controller
51 . . . main controller
52 . . . conveyance controller
53 . . . recording-material heating controller
54 . . . head controller
55 . . . fixation controller
56 . . . read controller
57 . . . blowing controller
58 . . . roller-heating controller
61 . . . storage
62 . . . input/output interface
63 . . . display-manipulation receiver
65 . . . exterior body
69 . . . bus
70, 71, 72, 73, 74, 77, 78 . . . shielding member
75 . . . blower
76 . . . gas channel
79 . . . roller heating unit
80, 82, 83, 84, 85 . . . heated air
81 . . . air
226 . . . temperature sensor
311 . . . conveyance belt
312 . . . drive roller
313 . . . driven roller
315 . . . conveyance motor
321, 322, 323 . . . supporter
331 . . . inkjet head
332 . . . ink heating unit
333 . . . discharge driver
341 . . . ultraviolet-ray irradiator
351 . . . image capturer
511 . . . CPU
512 . . . RAM
513 . . . ROM
741, 771, 781 . . . first shielding member
742, 772, 782 . . . second shielding member

The invention claimed is:

1. An image-forming apparatus comprising:

a conveyer that conveys a recording material on a conveyance path, an image-former that discharges ink onto the conveyed recording material, a recording-material heating unit that heats the recording material disposed in an upstream side in a conveyance direction of the recording material with respect to the image-former, a chassis that covers the recording-material heating unit, has a recording-material inlet provided in the upstream side in the conveyance direction of the recording material with respect to the recording-material heating unit, and has a recording-material outlet provided in a downstream side in the conveyance direction of the recording material with respect to the recording-material heating unit; and a shielding member that is disposed above the conveyance path and between the recording-material outlet and the image-former and shields inflow of air into the image-former, the air being discharged from the recording-material outlet, wherein the shielding member is a plate-like member disposed at a position that does not contact the recording material in an image-formation-surface side of the recording material of the conveyance path, and wherein a center of the plate-like member is disposed in in the upstream side in the conveyance direction of the recording material compared with an end of the plate-like member in a direction orthogonal to the conveyance direction of the recording material.

2. The image-forming apparatus according to claim 1, wherein the recording-material heating unit has a contactless heating apparatus that heats the recording material without contact.

3. The image-forming apparatus according to claim 1, wherein an end of the plate-like member in the conveyance path side is disposed to be inclined toward an upstream side in the conveyance direction of the recording material compared with another end in an opposite side of the conveyance path side.

4. The image-forming apparatus according to claim 1, wherein the shielding member constitutes a gas channel into which air discharged from the recording-material outlet is introduced.

5. The image-forming apparatus according to claim 4, wherein the gas channel is provided with a blower that moves the air introduced into the gas channel.

6. The image-forming apparatus according to claim 4, wherein the gas channel has a shape that introduces the air from the gas channel to the upstream side of the recording material of the chassis in the conveyance direction.

7. The image-forming apparatus according to claim 1, wherein the shielding member is a flexible member disposed at a position that can contact the recording material in an upper side of an image formation surface of the recording material in the conveyance path.

8. The image-forming apparatus according to claim 1, wherein the shielding member is a roller member that is disposed in an upper side of an image formation surface of the recording material in the conveyance path, is in contact with the recording material, and is rotatably retained.

9. The image-forming apparatus according to claim 1, wherein the recording-material heating unit has a first recording-material heating unit disposed in the image formation surface side of the recording material and has a second recording-material heating unit disposed in an opposite surface side of the image formation surface.

10. The image-forming apparatus according to claim 9, further comprising a controller that controls driving of the recording-material heating unit; wherein the controller independently controls output of the first recording-material heating unit and output of the second recording-material heating unit.

11. An image-forming apparatus comprising:

a conveyer that conveys a recording material on a conveyance path, an image-former that discharges ink onto the conveyed recording material, a recording-material heating unit that heats the recording material disposed in an upstream side in a conveyance direction of the recording material with respect to the image-former, a chassis that covers the recording-material heating unit, has a recording-material inlet provided in the upstream side in the conveyance direction of the recording material with respect to the recording-material heating unit, and has a recording-material outlet provided in a downstream side in the conveyance direction of the recording material with respect to the recording-material heating unit; and a shielding member that is disposed above the conveyance path and between the recording-material outlet and the image-former and shields inflow of air into the image-former, the air being discharged from the recording-material outlet, wherein the shielding member constitutes a gas channel into which air discharged from the recording-material outlet is introduced, and wherein the gas channel has a shape that introduces the air from the gas channel into the chassis.

12. An image-forming apparatus comprising:

a conveyer that conveys a recording material on a conveyance path, an image-former that discharges ink onto the conveyed recording material, a recording-material heating unit that heats the recording material disposed in an upstream side in a conveyance direction of the recording material with respect to the image-former, a chassis that covers the recording-material heating unit, has a recording-material inlet provided in the upstream side in the conveyance direction of the recording material with respect to the recording-material heating unit, and has a recording-material outlet provided in a downstream side in the conveyance direction of the recording material with respect to the recording-material heating unit; and a shielding member that is disposed above the conveyance path and between the recording-material outlet and the image-former and shields inflow of air into the image-former, the air being discharged from the recording-material outlet, wherein the shielding member is a roller member that is disposed in an upper side of an image formation surface of the recording material in the conveyance path, is in contact with the recording material, and is rotatably retained, and wherein the roller member is provided with a roller heating unit that heats a part of the roller member that contacts the recording material.

* * * * *